US010112762B2

(12) United States Patent
Tritz et al.

(10) Patent No.: US 10,112,762 B2
(45) Date of Patent: Oct. 30, 2018

(54) FLAT SEAL CONTAINER

(71) Applicant: PHILIP MORRIS PRODUCTS S.A., Neuchatel (CH)

(72) Inventors: Poh Yoke Tritz, Yverdon-les-Bains (CH); Sergey Krasiev, Le Mont-sur-Lausanne (CH); Philippe Bourgoin, Echallens (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 15/561,832

(22) PCT Filed: Jul. 1, 2016

(86) PCT No.: PCT/EP2016/065585

§ 371 (c)(1),
(2) Date: Sep. 26, 2017

(87) PCT Pub. No.: WO2017/005655

PCT Pub. Date: Jan. 12, 2017

(65) Prior Publication Data

US 2018/0111739 A1 Apr. 26, 2018

(30) Foreign Application Priority Data

Jul. 3, 2015 (EP) ..... 15175357

(51) Int. Cl.

| | |
|---|---|
| ***B65D 85/00*** | (2006.01) |
| ***B65D 75/58*** | (2006.01) |
| ***B65D 85/10*** | (2006.01) |

(52) U.S. Cl.
CPC ..... *B65D 75/5838* (2013.01); *B65D 85/1027* (2013.01); *B65D 85/1045* (2013.01)

(58) Field of Classification Search
USPC ..... 206/242, 259, 260, 271, 273, 274
See application file for complete search history.

(56) References Cited

U.S. PATENT DOCUMENTS

| | | | | |
|---|---|---|---|---|
| 2,152,398 | A | 3/1939 | Walker | |
| 3,432,310 | A * | 3/1969 | Weeks | B65B 25/16 229/87.09 |
| 9,533,821 | B2 | 1/2017 | Buse | |

(Continued)

FOREIGN PATENT DOCUMENTS

| | | |
|---|---|---|
| DE | 2601306 | 7/1977 |
| DE | 102011119344 | 4/2013 |
| EP | 1459983 | 9/2004 |

OTHER PUBLICATIONS

PCT/EP2016/0065585 International Search Report and Written Opinion dated Sep. 20, 2016 (9 pages).

*Primary Examiner* — Jacob K Ackun
(74) *Attorney, Agent, or Firm* — Mueting, Raasch & Gebhardt, P.A.

(57) ABSTRACT

A hinge lid pack (100) of smoking articles comprising a bundle (104) of smoking articles having a plurality of faces wrapped in a wrapper (106) of flexible sheet material, a housing (102) comprising a pack body (108) and a pack lid (110) hinged to the pack body. Free edge margins of the generally inside surface of the wrapper are adhered together over a first (face 114) of the bundle to form a fin seal (112) that is adhered to the wrapper over a second face of the bundle.

15 Claims, 3 Drawing Sheets

(56) References Cited

U.S. PATENT DOCUMENTS

Figure 1:
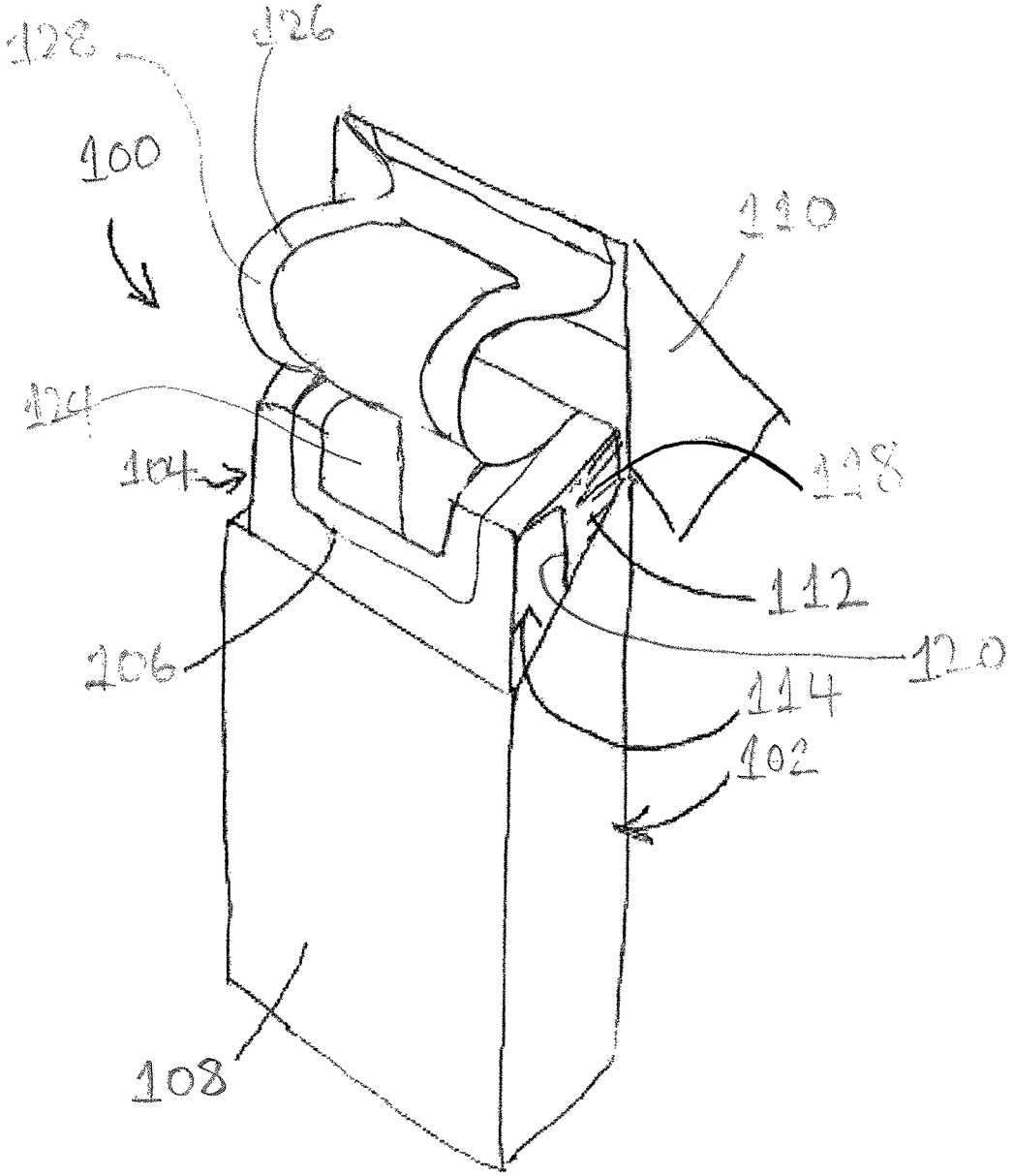

| | | | | |
|---|---|---|---|---|
| 2004/0173492 | A1* | 9/2004 | Kane, Jr. | B65B 9/067<br>206/494 |
| 2009/0190866 | A1* | 7/2009 | Hughes | B65D 75/44<br>383/207 |
| 2010/0140129 | A1* | 6/2010 | Sanfilippo | B65B 1/06<br>206/503 |
| 2011/0068155 | A1* | 3/2011 | Yoshimura | B65D 5/5425<br>229/117.27 |
| 2017/0088341 | A1* | 3/2017 | Fallon | B65D 75/5838 |
| 2017/0341852 | A1* | 11/2017 | Bray | B65D 75/5838 |
| 2018/0162631 | A1* | 6/2018 | Bray | B65D 75/5838 |

* cited by examiner

FLAT SEAL CONTAINER

This application is a U.S. National Stage Application of International Application No. PCT/EP2016/065585, filed Jul. 1, 2016, which was published in English on Jan. 12, 2017, as International Publication No. WO 2017/005655. International Application No. PCT/EP2016/065585 claims priority to European Application No. 15175357.1 dated Jul. 3, 2015.

The present invention relates to containers of smoking articles, such as hinge lid packs of cigarettes or other smoking articles.

Cigarettes and other smoking articles are commonly sold in packs of card in which the cigarettes or other smoking articles are held in bundle wrapped in a flexible sheet material such as of metal foil or polypropylene. The sheet material may be wrapped around the bundle but not sealed, or it may be sealed around the bundle to preserve the cigarettes or other smoking articles more effectively. The sheet material may be sealed by envelope seals, in which the lower surface of one edge margin of the sheet overlies the upper surface of another edge margin and is adhered thereto, or by fin seals, in which the lower surfaces of to edge margins of the sheet are adhered together and folded flat against the sheet material immediately adjacent the fin seal.

Envelope seals are regarded as less effective as seals than fin seals; there is a greater tendency for envelope seals to have flaws compared to fin seals. However, the relatively thick fin seals have adverse implications for the high speed manufacture of packs, as the effective size of the bundle is greater than with envelope seals, and the fin seals may interfere with the functionality of the pack, such as the opening of a hinged lid. Envelope seals produce only a double thickness of sheet material as compared to a triple thickness in the case of fin seals, where the fin seal overlies the sheet material immediately adjacent the seal.

In a first aspect of the invention, there is provided a container of smoking articles comprising a bundle of smoking articles having a plurality of faces wrapped in a wrapper of flexible sheet material, free edge margins of the generally inside surface of the wrapper being adhered together over a first face of the bundle to form a fin seal and an outer housing around the wrapped bundle, in which the fin seal is adhered to the wrapper over a second face of the bundle.

Some embodiments of the invention further comprise a fin seal retention panel adhered to a face of the wrapped bundle and extending over and being adhered to at least part of the wrapper over at least one of the first and second faces of the bundle to secure the fin seal thereto.

In some embodiments of the first aspect of the invention, a second fin seal is provided over a face of the wrapped bundle opposite the said first face and in which the second fin seal is adhered to another face of the wrapped bundle. In some such embodiments, the second fin seal is adhered to the said second face of the wrapped bundle.

In a second aspect of the invention, there is provided a container of smoking articles comprising a bundle of smoking articles having a plurality of faces wrapped in a wrapper of flexible sheet material, free edge margins of the generally inside surface of the wrapper being adhered together over a first face of the bundle to form a fin seal, an outer housing around the wrapped bundle, and a fin seal retention panel adhered to a second face of the wrapped bundle and extending over and being adhered to at least part of the wrapper over the first face of the bundle to secure the fin seal thereto.

In some embodiments of the second aspect of the invention, the wrapped bundle is a cuboid and the fin seal retention panel is generally cruciform and is adhered to the second face and to the four faces abutting the second face. By 'abutting' in this context it is meant that the faces have a common edge.

In some embodiments of the second aspect of the invention, a second fin seal is provided over a third face of the wrapped bundle opposite the said first face and in which the fin seal retention panel is adhered to the said third face to secure the second fin seal thereto.

In some embodiments of the second aspect of the invention, the first face abuts the second face.

A fin seal is made by bringing together the inside surfaces of the free edge margins of the sheet material wrapper around the bundle. The edge margins are sealed together, for example by heat or adhesive, and the seal is folded against the rest of the wrapper along a fold line across the face of the wrapped bundle over which the seal is formed. A fin seal includes a sealed part, generally extending from the free edge of the seal, or close to the free edge, toward the pack. Although this sealed portion may extend to the fold where the seal joins the rest of the wrapper, there is usually an unsealed portion between the sealed portion and the fold, where the edge margins overlie each other but are not adhered together.

It has been found that providing a fin seal over one or both side walls of a pack assists in retaining the shape of the bundle of smoking articles. In some embodiments of the invention, the container is a hinge lid pack, in which the hinge is across the rear wall of the pack and the fin seal is formed over a side wall of the pack. In some such embodiments, the second face of the bundle is the rear face. In some embodiments of the invention, there are two fin seals, one over each side wall of the pack.

In containers according to the first aspect of the invention, the fin seal is held tightly against the wrapper by being folded across the first face of the bundle and affixed to the second face. This minimizes the difference in the dimensions of the bundle compared to a bundle having only envelop seals, allowing the bundle to be processed on conventional packaging machinery. In containers according to the second aspect of the invention, the fin seal is held tightly against the wrapper by the retention panel. The fin seal on containers according to the invention will not interfere with the proper action of the container lid as it opens and closes. This is particularly important in the case of hinge lid packs. Hinge lid packs are commonly used for packaging cigarettes and other rod like smoking articles. Hinge lid packs are cuboid (that is, they are regular packs with six rectangular faces), and comprise a body portion that holds the smoking articles and a lid hinged to the pack across wall, usually referred to as the rear wall of the pack. On a hinge lid pack, the pack lid has side and front walls in addition to the rear wall along which it is hinged to the pack body. Typically, the side walls of the pack lid slide over the side walls of the pack body as the lid is opened and shut; any distortion of the pack body caused by fin seals may cause the pack body side walls to interfere with the pack lid side walls, preventing smooth operation of the lid, particularly lid closure. The present invention ensures that fin seals add as little as possible to the width of the wrapped bundle, minimizing the risk that the lid will not open and close smoothly.

The invention also provides a method of making a container of smoking articles according to the first aspect of the invention comprising providing a bundle of smoking articles, wrapping the bundle in a wrapper of flexible sheet material to form a wrapped bundle of smoking articles having a plurality of faces, bringing together free edge margins of the generally inside surface of the wrapper over a first face of the bundle, adhering the said free edge margins together to form a fin seal, folding the fin seal onto a second face of the wrapped bundle, adhering the fin seal to the said second face, and providing an outer housing around the wrapped bundle.

In some embodiments, the method further comprises providing a fin seal retention panel, adhering the fin seal retention panel to a face of the wrapper and to at least part of the first or the second face of the wrapper to secure the fin seal thereto and providing an outer housing around the wrapped bundle.

The invention also provides a method of making a container of smoking articles according to the second aspect of the invention comprising providing a bundle of smoking articles, wrapping the bundle in a wrapper of flexible sheet material to form a wrapped bundle of smoking articles having a plurality of faces, bringing together free edge margins of the generally inside surface of the wrapper over a first face of the bundle, adhering the said free edge margins together to form a fin seal, providing a fin seal retention panel, adhering the fin seal retention panel to a second face of the wrapper and to at least part of the first face of the wrapper to secure the fin seal thereto, and providing an outer housing around the wrapped bundle.

In some methods according to the invention, a further fin seal is provided on a face of the bundle opposite the said first face.

In some methods according to the invention the step of providing an outer housing around the wrapped bundle comprises wrapping a blank for the housing around the wrapped bundle. In such methods for making containers according to the first aspect of the invention, the fin seal is folded onto the second face as the housing blank is wrapped around the wrapped bundle.

In some methods according to the invention the step of providing an outer housing around the wrapped bundle comprises wrapping a blank for a hinge lid pack around the wrapped bundle.

A container according to the invention may include an inner frame inside the container, to increase the structural resilience of the container. Preferably, the inner frame is a U-shaped inner frame having a front wall and a pair of opposed side walls. The term "U-shaped" is used to refer to a shape that comprises three parts in which the first and the third part are parallel to each other and extend in the same direction perpendicular to the second part. Preferably, the front wall of the inner frame is provided adjacent the front wall of the container. Advantageously, an inner frame with a large surface area provided adjacent the front wall of the package increases the structural strength of the container. The increased structural strength provided by the inner frame allows more secure closing of the closure panel. This is particularly advantageous for subsequent closing operations, when the container is no longer full Preferably, the inner frame has a cut-out at the top of the front wall to make it easier to remove articles from the container.

As used herein, the terms 'front', 'back', 'upper', 'lower', 'top', 'bottom' and 'side', refer to the relative positions of portions of containers according to the invention and components thereof when the container is in an upright position with the lid of the outer housing in the closed position and the hinge line, where present at the back of the container. When describing containers according to the present invention, these terms are used irrespective of the orientation of the container being described. The back wall of the container is the wall with the hinge line.

The term "longitudinal" refers to a direction from bottom to top or vice versa. The term "transverse" refers to a direction perpendicular to the longitudinal direction across the front (or back) wall of the container.

As used herein, the term "height" refers to the dimension in the longitudinal direction of the container. The term "width" refers to the dimension in the transverse direction when the adhesive label is affixed to the inner package.

The term "hinge line" refers to a line about which the lid can be pivoted in order to open the container. A hinge line may be, for example, a fold line, a crease line or a score line in the panel forming the back wall of the container.

The housing of a container according to the invention may be formed from any suitable materials including, but not limited to, cardboard, paperboard, plastic, metal, or combinations thereof. Preferably, the housing is formed from one or more folded laminar cardboard blanks and preferably, the cardboard has a weight of between about 100 grams per square metre and about 350 grams per square metre.

The bundle wrapper may be of a flexible sheet material. Preferably, it is of metallised polymeric film, and may be heat sealable. The bundle wrapper material may be formed as a laminate of a metallised polyethylene film and a liner material. The liner material may be a supercalendered glassine paper. In addition, the inner package material may be provided with a print-receptive top coating.

The container is preferably a rectangular parallelepiped comprising two wider walls spaced apart by two narrower walls with right-angled longitudinal and right-angled transverse edges. Alternatively, the container may have one or more rounded longitudinal edges, rounded transverse edges, beveled longitudinal edges or beveled transverse edges, or combinations thereof. For example, the container according to the invention may have, without limitation:

one or two longitudinal rounded or beveled edges on the front wall, and/or one or two longitudinal rounded or beveled edges on the back wall;

one or two transverse rounded or beveled edges on the front wall, and/or one or two transverse rounded or beveled edges on the back wall;

one longitudinal rounded edge and one longitudinal beveled edge on the front wall, and/or one transverse rounded edge and one transverse beveled edge on the back wall;

one or two transverse rounded or beveled edges on the front wall and one or two longitudinal rounded or beveled edges on the front wall;

two longitudinal rounded or beveled edges on a first side wall or two transverse rounded or beveled edges on the second side wall.

Where the container has a beveled edge, the beveled edge preferably has a width of between about 1 mm and about 10 mm, preferably between about 2 mm and about 6 mm. Alternatively, the container may comprise a double bevel formed by three parallel creasing or scoring lines that are spaced such that two distinct bevels are formed on the edge of the container. Alternatively, the container may have a non-rectangular transversal cross section, for example polygonal such as triangular or hexagonal, semi-oval or semi-circular.

Containers according to the invention find particular application as packs for elongate smoking articles such as cigarettes, cigars or cigarillos. It will be appreciated that through appropriate choices of the dimensions of the containers, containers according to the invention may be designed for different numbers of conventional size, king size, super-king size, slim or super-slim cigarettes. Alternatively, other consumer goods may be housed inside the container.

Through an appropriate choice of the dimensions of the containers, containers according to the invention may be designed to hold different total numbers of smoking articles, or different arrangements of smoking articles. For example, containers according to the invention may be designed to hold a total of between ten and thirty smoking articles.

Figure 2:
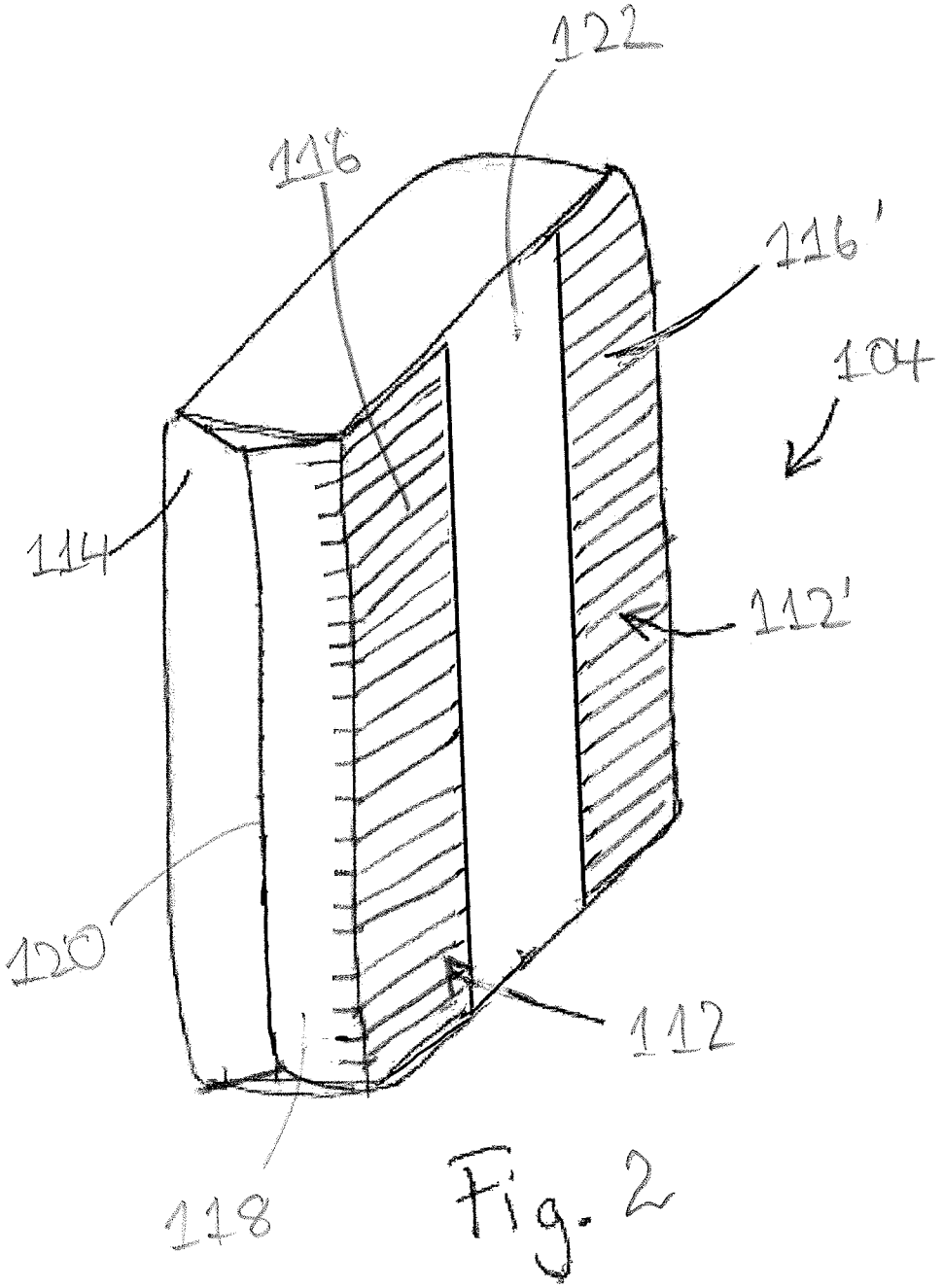
Figure 3:
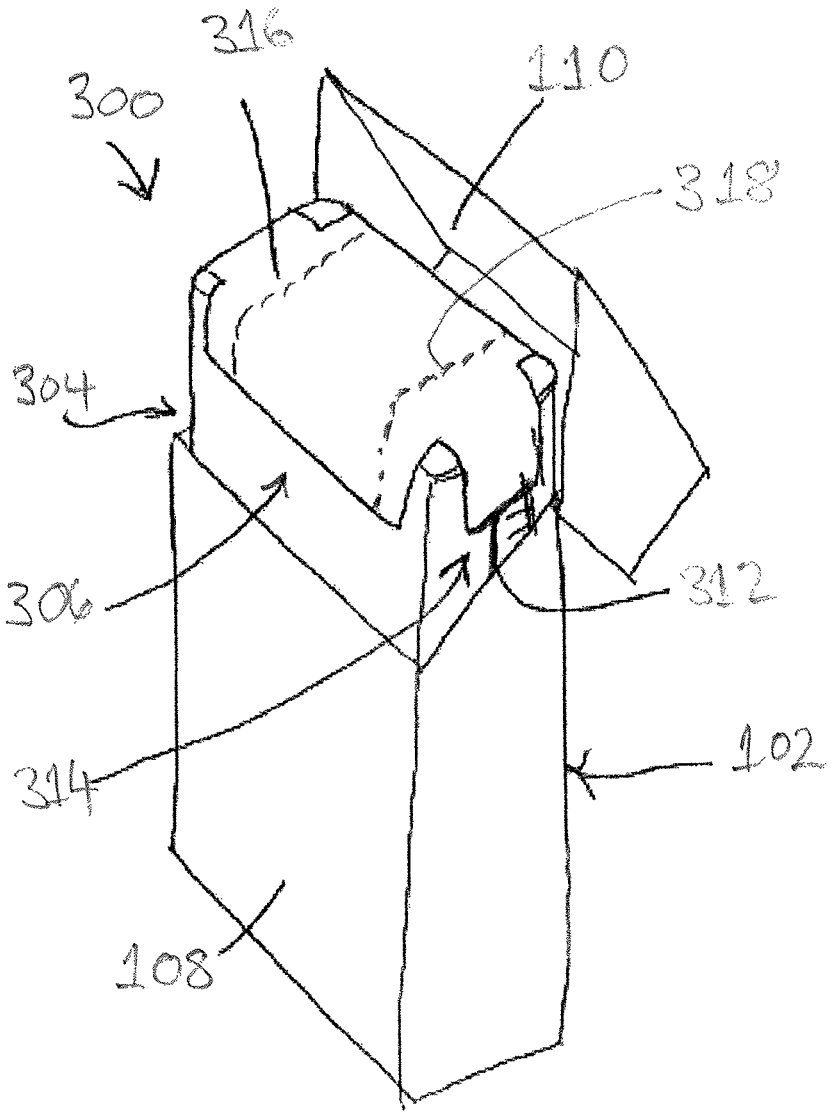

The invention will be further described, by way of example, with reference to the drawings, in which:

FIG. 1 shows an isometric view from the front and one side of a container according to the second aspect of the invention; and FIG. 2 shows an isometric view of the bundle of the pack of FIG. 1 with the housing of FIG. 1 not shown from the rear and one side (with reference to the orientation of the bundle in FIG. 1), with the housing of FIG. 1 not shown; and FIG. 3 shows an isometric view from the front and one side of a container according to the first aspect of the invention.

The containers of FIGS. 1 and 3 are hinge lid packs, the outer housings of which are of similar design and construction, and like elements are shown by the same reference numerals in both figures. The packs 100, 300 each comprise an outer housing 102 of card and a wrapped bundle 104, 304 of cigarettes (not visible is the figures) surrounded by a wrapper 106, 306 of metallised polymeric film. The outer housing 102 comprises a pack body 108 and a pack lid 110 hinged to the body along a hinge line (not visible in the figures) across the rear wall of the housing, each having opposed front and rear walls and opposed side walls; the pack body 108 has a bottom wall (not visible in the figures) and the pack lid 110 has a top wall (not visible in the figures).

The wrapper 106 of the bundle 104 of the pack 100 of FIG. 1 is wrapped around the cigarettes and a vertical fin seal 112 is formed over a side face 114 of the bundle. The fin seal 112 extends from the rest of the wrapper 106. The fin seal 112 extends from the rest of the wrapper 106 along a fold line 116. The fin seal is joined to the rest of the wrapper 106 along a vertical fold line 116 down the side face 114 of the bundle. A similar fin seal 112' is formed over the other side wall, seen in FIG. 2. Each fin seal 112, 112' is formed of free edge margins of the inside surfaces of the wrapper 106. These are brought together and heat sealed together to form the fin seal. In other embodiments, the edge margins can be sealed together with adhesive. Each fin seal comprises a sealed portion 116, 116' extending from the free edge of the seal toward the bundle and an unsealed portion 118 that extends from the sealed portion to a fold line 120 in the wrapper 106 that extends vertically down the side face 114 over which the seal is made. Preferably, the sealed portion extends between about 0.6 cm and about 2 cm from the free edges of the wrapper and the overall length of the seal is between about 2 cm and 4 cm.

Each fin seal 112, 112' of the pack 100 of FIG. 1 is folded tightly around the respective edge between the respective side face 114 and the rear wall 120 of the wrapped bundle 104, and adhered to the bundle wrapper 106. This retains the fin seals tightly against the bundle wrapper, which assists on retaining the shape of the bundle 104 and ensures that the seal does not impede operation of the lid 110.

In the embodiment of FIG. 1, the bundle wrapper 106 is self sealing. The bundle wrapper has an opening 124 in its top and front faces that provides access to the cigarettes in the bundle 104 that is closed by a closure panel 126 slightly larger than the opening 124 and having a resealable adhesive around its margins 128 that overlie the bundle wrapper 106 when the pack is closed. The lower (when the pack is closed) edge of the closure panel 126 is firmly fixed to the inside of the lower front edge of the pack lid 110. When the pack is opened, the movement of the lid causes the closure panel to be peeled off the wrapper 106 to expose the opening 124 in the wrapper and so give access to the cigarettes in the pack. As the lid is closed, the closure panel is brought onto the wrapper over the opening and sealed to it by the resealable adhesive.

In the manufacture of the hinge lid pack 100 of FIG. 1, a bundle of cigarettes is provided from a hopper of cigarettes. Typically, this is a bundle of twenty cigarettes in a 7-6-7 formation, but other numbers of cigarettes and other formations may be provided. A sheet of metallised polymeric film or other wrapper material is wrapped over the top of the bundle; in the case of a self sealing bundle as shown in FIG. 1, the wrapper will have an opening 124 in it and the closure panel 126 will be in place over the opening. Fin seals are formed over each of the two side walls and the bottom wall of the bundle by bringing the free edge margins of the sheet together over these walls and heat sealing or otherwise adhering them together to form fin seals as described above. The wrapped bundle 106 is then wrapped with a hinge lid pack blank. As the blank is wrapped around the bundle 106, the fin seals 112, 112' are swept back and folded against the side walls 114 of the bundle along fold lines 120, around the edges between the side walls 114 and the rear wall 122 of the bundle and adhered to the rear wall. The wrapping of the bundle with the hinge lid pack blank is completed and the lower edge of the closure panel is fixed to the lower edge of the lid to form the finished pack, which may be overwrapped in a conventional manner.

In the pack of FIG. 3, the wrapper 106 of the bundle 104 of the pack 100 is wrapped around the cigarettes and a vertical fin seal 312 is formed over each of the side faces 314 of the bundle (one of which is visible in FIG. 3). The fin seals 312 are of the same construction as those of the embodiment of FIGS. 1 and 2. Each fin seal 312 can be long enough to be folded onto the rear or front wall of the wrapped bundle 304 or short enough to be folded only onto the side face 314 over which it is formed. The fin seals 312 of the bundle are held tight against the wrapped bundle 314 by a cruciform seal retention panel 316. The retention panel is a sheet of flexible material of, for example, high density polyethylene (HDPE), low density polyethylene (LDPE) biaxially oriented polyproplyene (BOPP), nylon, polystyrene, cellulosic films such as Cellophane™ and cellulose acetate, polyvinylchloride (PVC), paper (for example, paper made from hemp fibre), polyethylene terephthalate (PET), metallised plastics film and mixtures of the foregoing. The retention panel is advantageously between about 40 μm and about 120 μm thick. The retention panel is a sheet of in the form of a cross; the central portion of the cross, where the arms of the cross meet, is slightly smaller in side to side width and front to back depth than the top face of the wrapped bundle 304, and the arms of the cross extend a short way down the front, rear and side faces of the bundle. The retention panel 316 is adhered to the top face of the bundle and the front, rear and side and holds the fin seal against the side face of the bundle, minimizing the extra side to side width provided by the fin seal. In embodiments in which the fin seal 312 is long enough to be folded onto the front or rear face of the wrapped bundle, the retention panel holds the fin seal against that wall as well. In other embodiments, the retention panel is not cruciform, but extends only over the faces of the bundle onto which the fin seal is folded and an adjacent face.

In the embodiment shown if FIG. 3, a line of weakness 318, for example a score line, extends across the top and front faces of the wrapped bundle 304 to assist in opening the bundle to gain access to the cigarettes.

The manufacturing process for a pack of the embodiment of FIG. 3 is similar that for the pack of FIG. 1. As the wrapped bundle is wrapped in the hinge lid blank, the fin seals 312 are swept back to fold onto the side faces 314 of the wrapped bundle 306. The seal retention panel 316 is applied to the top, front, rear and side walls of the wrapped bundle to retain the seals 312 in place against the bundle, and wrapping of the bundle with the hinge lid blank is completed. The pack may be overwrapped in a conventional manner.

It will be appreciated that in containers according to the invention, the fin seal can be over any face of the bundle, and that the bundle may have one, two, three or more fin seals, any or all of which are held against the bundle in accordance with the first or second aspect of the invention, or both.

Ensuring that the fin seal is held tightly against the bundle allows the bundle to be wrapped in the outer housing on conventional packaging machinery at normal packaging speeds. It also ensures that the lid of a hinge lid pack can open and shut without fouling the fin seal, and contributes to a desirable appearance to the open container.

The invention claimed is:

1. A container of smoking articles comprising:

a bundle of smoking articles having a plurality of faces wrapped in a wrapper of flexible sheet material, free edge margins of the generally inside surface of the wrapper being adhered together over a first face of the bundle to form a fin seal that is joined to the rest of the wrapper along a fold line; and an outer housing around the wrapped bundle, in which the fin seal is folded around an edge of the bundle that is parallel to the fold line, and the fin seal is adhered to the wrapper over a second face of the bundle.

2. A container according to claim 1 in which a second fin seal is provided over a face of the wrapped bundle opposite the said first face and in which the second fin seal is adhered to another face of the wrapped bundle.

3. A container according to claim 1 in which the second fin seal is adhered to the said second face of the wrapped bundle.

4. A container according to claim 1 further comprising a fin seal retention panel adhered to a face of the wrapped bundle and extending over and being adhered to at least part of the wrapper over at least one of the first and second faces of the bundle to secure the fin seal thereto.

5. A container according to claim 4 in which the wrapped bundle is a cuboid and the fin seal retention panel is generally cruciform and is adhered to the second face and to the four faces abutting the second face.

6. A container according to claim 4 in which a second fin seal is provided over a third face of the wrapped bundle opposite the said first face and in which the fin seal retention panel is adhered to the said third face to secure the second fin seal thereto.

7. A container according to claim 1 in which the first face abuts the second face.

8. A hinge lid pack according to claim 1 in which the hinge is across the rear wall of the pack and the fin seal is formed over a side wall of the pack.

9. A hinge lid pack according to claim 8 including two fin seals, one over each side wall of the pack.

10. A hinge lid pack according to claim 1 in which second face of the bundle is the rear face.

11. A method of making a container of smoking articles according to claim 1 comprising:

providing a bundle of smoking articles;

wrapping the bundle in a wrapper of flexible sheet material to form a wrapped bundle of smoking articles having a plurality of faces;

bringing together free edge margins of the generally inside surface of the wrapper over a first face of the bundle;

adhering the said free edge margins together to form a fin seal;

folding the fin seal onto a second face of the wrapped bundle;

adhering the fin seal to the said second face; and providing an outer housing around the wrapped bundle.

12. A method according to claim 11 in which the step of providing an outer housing around the wrapped bundle comprises providing a blank for a hinge lid pack.

13. A method according to claim 11 in which the step of providing an outer housing around the wrapped bundle comprises wrapping a blank for the housing around the wrapped bundle and in which the fin seal is folded onto the second face as the housing blank is wrapped around the wrapped bundle.

14. A method according to claim 11 of making a container of smoking articles further comprising:

providing a fin seal retention panel;

adhering the fin seal retention panel to a face of the wrapper and to at least part of the first or the second face of the wrapper to secure the fin seal thereto; and providing an outer housing around the wrapped bundle.

15. A method according to claim 11 in which a further fin seal is provided on a face of the bundle opposite the said first face.

* * * * *